US006162022A

United States Patent [19]

Anderson et al.

[11] Patent Number: 6,162,022

[45] Date of Patent: Dec. 19, 2000

[54] HYDRAULIC SYSTEM HAVING A VARIABLE DELIVERY PUMP

[75] Inventors: Michael D. Anderson, East Peoria; Dennis H. Gibson, Chillicothe; Ronald D. Shinogle, Peoria, all of Ill.; Matthew D. Friede, Fort Wayne, Ind.

[73] Assignee: Caterpillar Inc., Peoria, Ill.

[21] Appl. No.: 09/434,410

[22] Filed: Nov. 4, 1999

Related U.S. Application Data

[63] Continuation of application No. 09/084,635, May 26, 1998, abandoned.

[51] Int. Cl.[7] ..... F02M 47/02

[52] U.S. Cl. ..... 417/213; 417/298; 417/273

[58] Field of Search ..... 417/213, 298, 417/273, 205

[56] References Cited

U.S. PATENT DOCUMENTS

| | | |
|---|---|---|
| 3,183,850 | 5/1965 | Raymond . |
| 3,809,507 | 5/1974 | Baglai . |
| 3,827,831 | 8/1974 | Lines . |
| 4,519,752 | 5/1985 | Valentin . |
| 4,531,372 | 7/1985 | Slaubaugh . |
| 4,578,956 | 4/1986 | Young . |
| 4,667,477 | 5/1987 | Matsuda et al. . |
| 4,680,936 | 7/1987 | Sarwinski et al. . |
| 4,681,514 | 7/1987 | Griese et al. . |
| 4,710,106 | 12/1987 | Iwata et al. . |
| 4,719,889 | 1/1988 | Amann et al. . |
| 4,722,661 | 2/1988 | Mizuon . |
| 4,723,891 | 2/1988 | Takenaka et al. . |
| 4,730,986 | 3/1988 | Kayukawa et al. . |
| 4,735,185 | 4/1988 | Imoto et al. . |
| 4,771,676 | 9/1988 | Matsumoto et al. . |
| 4,801,247 | 1/1989 | Hashimoto et al. . |
| 4,813,342 | 3/1989 | Schneider et al. . |
| 4,849,017 | 7/1989 | Sahasi et al. . |
| 4,850,818 | 7/1989 | Kotera . |
| 4,975,025 | 12/1990 | Yamamura et al. . |
| 4,997,297 | 3/1991 | Blount . |
| 5,017,102 | 5/1991 | Shimaguchi et al. . |
| 5,035,221 | 7/1991 | Martin . |
| 5,156,531 | 10/1992 | Schmid et al. . |
| 5,167,493 | 12/1992 | Kobari . |
| 5,176,066 | 1/1993 | Kanamaru et al. . |
| 5,207,981 | 5/1993 | Hanaue et al. . |
| 5,209,652 | 5/1993 | Fischer et al. . |
| 5,213,083 | 5/1993 | Glassey . |
| 5,230,570 | 7/1993 | Bursey, Jr. et al. . |
| 5,248,245 | 9/1993 | Behnke et al. . |
| 5,263,829 | 11/1993 | Gergets . |
| 5,280,745 | 1/1994 | Maruno . |
| 5,291,739 | 3/1994 | Woods et al. . |
| 5,317,879 | 6/1994 | Goldberg et al. . |
| 5,318,410 | 6/1994 | Kawamura et al. . |
| 5,354,183 | 10/1994 | Eisenbacher et al. . |
| 5,368,451 | 11/1994 | Hammond . |
| 5,456,581 | 10/1995 | Jokela et al. . |
| 5,515,829 | 5/1996 | Wear et al. . |
| 5,558,003 | 9/1996 | Bauzou et al. . |
| 5,701,873 | 12/1997 | Schneider . |
| 5,800,130 | 9/1998 | Blass et al. . |
| 5,890,876 | 4/1999 | Suito et al. . |
| 5,931,644 | 8/1999 | Glassey et al. . |

FOREIGN PATENT DOCUMENTS

| | | |
|---|---|---|
| 0 270 720 | 6/1988 | European Pat. Off. . |
| 0 299 337 | 1/1989 | European Pat. Off. . |
| 0 809 203 | 11/1997 | European Pat. Off. . |
| 2 028 916 | 3/1980 | United Kingdom . |

*Primary Examiner*—Timothy S. Thorpe
*Assistant Examiner*—Trelita Perry
*Attorney, Agent, or Firm*—Michael McNeil

[57] ABSTRACT

A variable delivery liquid pump system includes a housing defining an inlet, an outlet and a plunger bore. A rotating shaft includes a cam that defines a fixed displacement distance with each rotation of the shaft. A plunger is slidably positioned in the plunger bore. A supply of liquid at a supply pressure is attached to the inlet by a supply passage. An output control mechanism includes an electronically-controlled flow restriction valve positioned in the supply passage. The plunger retracts less than the fixed displacement distance of the cam during each rotation of the shaft when the flow restriction valve is at least partially closed. The variable delivery pump is particularly suited for use in a hydraulically-actuated fuel injection system.

21 Claims, 5 Drawing Sheets

HYDRAULIC SYSTEM HAVING A VARIABLE DELIVERY PUMP

RELATION TO OTHER PATENT APPLICATION

This is a continuing patent application that claims the benefit under 35 USC §120 of prior patent application Ser. No. 09/084,635, filed May 26, 1998, with the same title as above, now abandoned.

TECHNICAL FIELD

The present invention relates generally to variable delivery liquid pumps, and more particularly to a hydraulic subsystem for an internal combustion engine that uses a variable delivery high pressure pump.

BACKGROUND ART

In general, a hydraulic system includes one or more hydraulically-actuated devices connected to a source of pressurized fluid. One example of such a system includes the hydraulically-actuated fuel injection systems manufactured by Caterpillar, Inc. of Peoria, Ill. for use on diesel engines. In current systems of this type, a plurality of hydraulically-actuated fuel injectors are mounted in an engine and connected to a common rail containing high pressure lubricating oil. The common rail is maintained pressurized by a fixed displacement pump that is driven directly by the engine. The pressure in the common rail is controlled by a conventional electronic control module that maintains pressure at a desired level by continuously dumping an amount of the pressurized oil back to the sump. While these hydraulically-actuated fuel injection systems have performed magnificently for many years, there remains room for improvement. In particular, controlling fluid pressure by dumping a portion of the pressurized fluid back to the oil pressure sump amounts to a waste of energy, which reveals itself as a higher than necessary brake specific fuel consumption for the engine. Thus, there remains room for improvement in the overall efficiency of the hydraulic system and engine if pressure in the common rail can be maintained and controlled without an excessive waste of energy through dumping pressurized fluid back to the sump.

The present invention is directed to these and other problems associated with pumps for hydraulic systems.

DISCLOSURE OF THE INVENTION

A variable delivery liquid pump system includes a housing that defines an inlet, an outlet and a plunger bore. The rotating shaft includes a cam that defines a fixed displacement distance with each rotation of the shaft. A plunger is slidably positioned in the plunger bore. A supply of liquid at a supply pressure is attached to the inlet by a supply passage. An output control mechanism includes an electronically-controlled flow restriction valve positioned in the supply passage. The output control mechanism causes the plunger to retract less than the fixed displacement distance of the cam during each rotation of the shaft when the flow restriction valve is at least partially closed.

In another embodiment, a hydraulic subsystem includes an engine having a lubricating oil sump. A low pressure pump is attached to the engine and has an inlet connected to the lubricating oil sump. A high pressure pump is attached to the engine and has an outlet connected to a high pressure common rail. The pump includes a rotating shaft with a cam that defines a fixed displacement distance with each rotation of the shaft, and further has a plurality of reciprocating plungers distributed around the shaft in a plane. An oil supply passage extends between an outlet from the low pressure pump to an inlet of the high pressure pump. A plurality of hydraulically-actuated devices have inlets connected to the high pressure common rail and outlets connected to the lubricating oil sump. An output control mechanism is capable of controlling a volume rate of oil delivered from the high pressure pump to the high pressure common rail, and includes an electronically-controlled flow restriction valve positioned in the oil supply passage. The plurality of reciprocating plungers retract less than the fixed displacement distance of the cam during each rotation of the shaft when the flow restriction valve is at least partially closed.

BEST MODE FOR CARRYING OUT THE INVENTION

Figure 1:
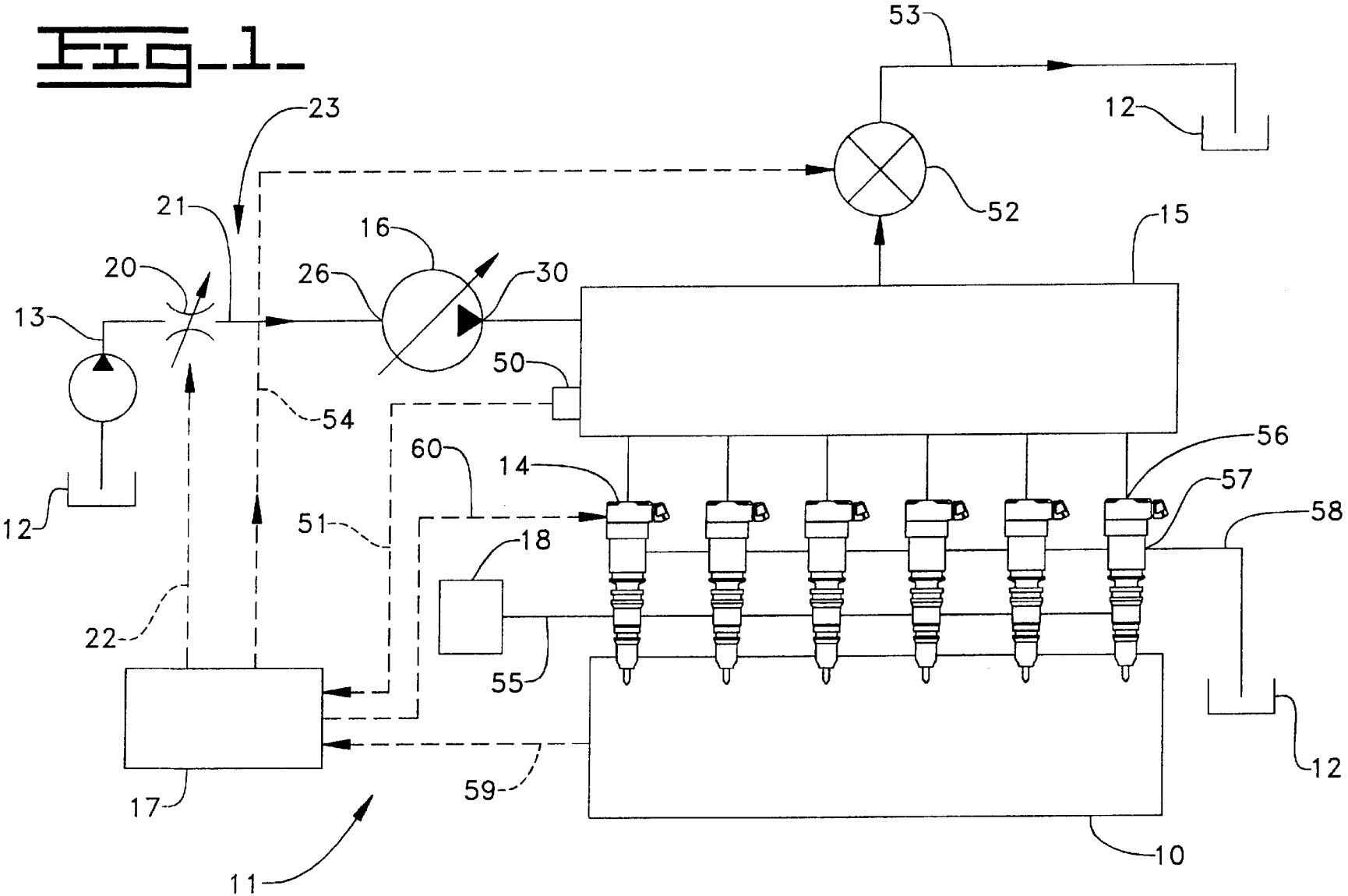
FIG. 1 is a schematic illustration of a hydraulic system according to one embodiment of the present invention.

Referring now to FIG. 1, an internal combustion engine 10 includes a hydraulic subsystem 11 attached thereto. System 11 includes a plurality of hydraulically-actuated devices, which in this case are hydraulically-actuated fuel injectors 14, but could also be other devices such as gas exchange valve actuators or exhaust brake actuators, etc. Fuel injectors 14 are powered in their operation by a high pressure actuation fluid, which is preferably high pressure lubricating oil contained in a common rail 15. A high pressure variable delivery pump 16, which is preferably driven directly by engine 10, maintains fluid pressure in common rail 15. Low pressure lubricating oil is supplied to high pressure pump 16 by a low pressure oil circulating pump 13, which draws oil directly from engine oil sump 12. In this embodiment, hydraulically-actuated fuel injection system 11 shares both the low pressure oil circulating pump 13 and engine oil sump 12 with the lubricating subsystem of engine 10.

Those skilled in the art will appreciate that the performance and operation of fuel injectors 14 is a strong function of the pressure of the lubricating oil in common rail 15. Like systems of the prior art, an electronic control module 17 uses a variety of sensor inputs and control mechanisms to control the magnitude of fluid pressure in common rail 15. For instance, electronic control module 17 can use an engine sensor 59 to determine the current speed and load conditions of engine 10, and use this information to calculate a desired pressure for common rail 15. This desired pressure can be compared to the actual pressure in common rail 15, which is measured by a pressure sensor 50 and communicated to electronic control module 17 via a communication line 51.

The primary control of fluid pressure in common rail 15 is maintained by an output control mechanism 23, which is capable of controlling a volume rate output from high pressure pump 16 to common rail 15. However, if electronic control module 17 determines that common rail 15 is substantially over-pressurized or there is a desire for a quick drop in pressure, electronic control module 17 can command a pressure relief valve 52 to be opened to quickly relieve pressure in common rail 15. Pressure relief valve 52 is positioned in a pressure relief passage 53 that extends between common rail 15 and engine oil sump 12. Pressure relief valve 52 is normally closed but can be commanded to open via a communication line 54 in a conventional manner.

During most of its operation, pressure relief valve 52 is closed, and the lubricating oil for hydraulic system 11 begins and ends its circuit in engine oil sump 12 along a different route. In particular, a supply passage 21 extends between the inlet 26 of high pressure pump 16 and an outlet from low pressure oil circulating pump 13. The output control mechanism 23 for high pressure pump 16 includes an electronically-controlled flow restriction valve 20 that is positioned in supply passage 21, and controlled in its operation by electronic control module 17 via a communication line 22. Flow restriction valve 20 controls the output from high pressure pump 16 by controlling the supply pressure and flow rate seen at inlet 26 of high pressure pump 16. In typical operation, flow restriction valve 20 is set to a position that causes high pressure pump 16 to continuously supply common rail 15 with some minimum flow rate of high pressure oil from outlet 30.

When engine 10 is operating, high pressure oil from common rail 15 is continuously consumed by fuel injectors 14. Thus, the output of high pressure pump 16 must match or exceed the collective demand of fuel injectors 14 in order for system 11 to perform properly. The inlets 56 of each fuel injector 14 are connected to common rail 15 via a separate branch passage. After performing work in the fuel injectors 14, the used oil exits fuel injectors 14 at outlets 57 and is returned to engine oil sump 12 via drain passage 58 for recirculation. Since hydraulic system 11 in this embodiment uses something other than fuel fluid as its hydraulic medium, fuel injectors 14 are continuously supplied with fuel via a fuel supply passage 55 that is connected to a source of fuel 18.

Figure 2:
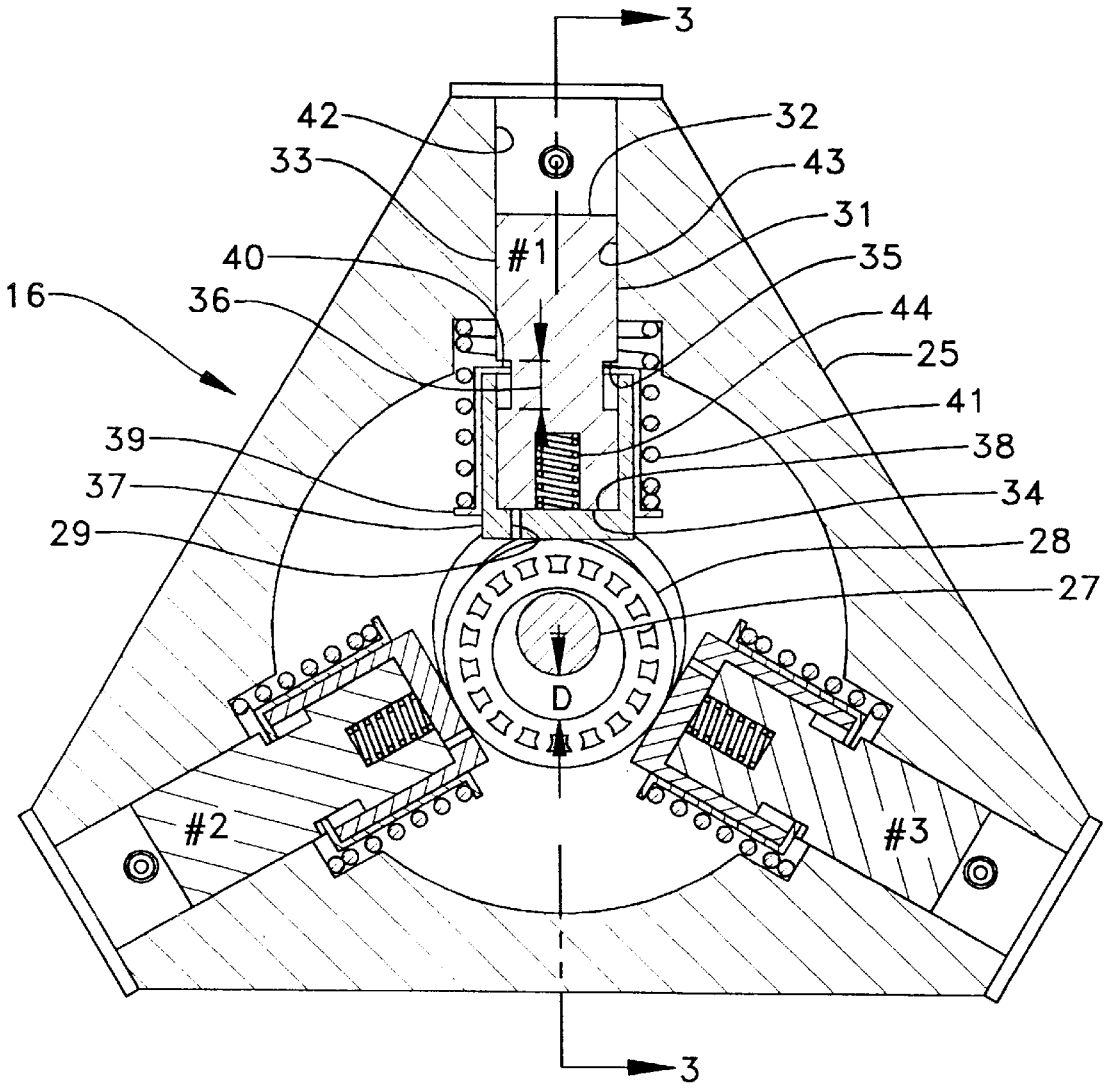
FIG. 2 is a front sectioned diagrammatic view of a variable delivery pump according to one aspect of the present invention.
Figure 3:
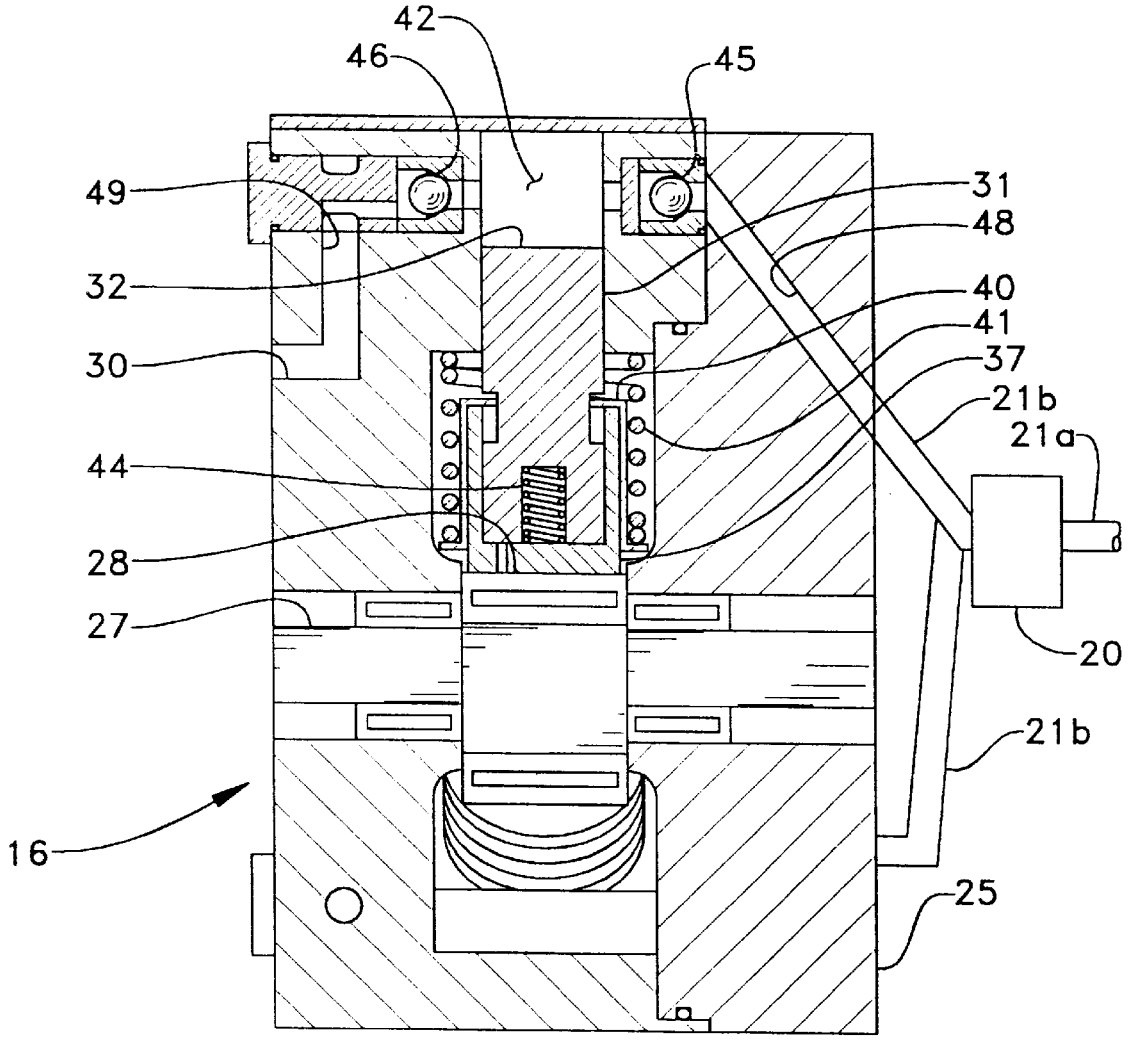
FIG. 3 is a sectioned side diagrammatic view of the variable delivery pump of FIG. 2 as viewed along section line 3—3.

Referring now to FIGS. 2 and 3, the structure of high pressure pump 16 is illustrated. Preferably, high pressure pump 16 has a number of reciprocating plungers that is related to the number of hydraulically-actuated devices in the system. In this example, high pressure pump 16 includes three reciprocating plungers, and engine 10 is preferably a four cycle diesel type engine having six cylinders, and hence six fuel injectors 14. In this way, the pumping cycle of the individual plungers can be made to coincide with the actuation timing of the fuel injectors so that the pressure in common rail 15 can be maintained as steady as possible. Thus, in the preferred embodiment, the number of reciprocating plungers and the pumping action of the same can be closely synchronized to the operation of the engine and corresponding hydraulically-actuated devices. Due to these concerns, packaging considerations and other engineering factors, the reciprocating plungers of the present invention are preferably positioned in a single plane that is oriented perpendicular to the pump's rotating shaft 27, which is preferably coupled directly to the drive shaft of engine 10. In this way, a single cam 28 can be utilized to actuate all three reciprocating plungers sequentially. Preferably, the structure and operation of all three plungers is substantially identical, except that they are 120° out of phase with one another. Therefore, only the structure and operation of plunger #1 will be described in detail.

Those skilled in the art will appreciate that a pump according to the present invention could have a variety of structures, such as axial, radial, or in-line configurations, and still fall within the contemplated scope of the invention. Thus, as used in this patent, the term "cam" is intended to encompass any conventional cam structures known in the art, such as a face cam or the illustrated radial cam for example. Similarly, those skilled in the art will also appreciate that other equivalent structures may be used to define a fixed displacement distance with each rotation of a shaft might, such as a conventional slider-crank structure for example.

High pressure pump 16 includes a pump housing 25 within which is positioned a reciprocating plunger 31 having a pressure face end 32 separated from a contact end 34 by a cylindrically shaped side surface 33. Plunger 31 moves in a plunger bore 43, which together with pressure face end 32 defines a pumping chamber 42. When plunger 31 is undergoing its return stroke, fluid flows into pumping chamber 42 past check valve 45 via inlet passage 48 and supply passage 21*b*. When plunger 31 is undergoing its pumping stroke, check valve 45 is closed, and an amount of fluid in pumping chamber 42 is displaced into outlet passage 49 past check valve 46. Outlet passage 49 opens through outlet 30, which is connected to high pressure rail 15 (FIG. 1) as stated earlier. Those skilled in the art will appreciate that the amount of fluid displaced with each reciprocation of plunger 31 is a function of how far plunger 31 reciprocates with each rotation of cam 28 and shaft 27. Although cam 28 defines a fixed displacement distance D, the output of the pump can be controlled by having plunger 31 reciprocate through a distance that is less than the fixed displacement distance D of cam 28.

In order to have the ability to vary the reciprocation distance of plunger 31, pump 16 includes a separate tappet 37 that is always maintained in contact with cam 28 via the action of tappet biasing spring 41 acting on tappet holder 39. Thus, with each rotation of shaft 27, tappet 37 and tappet holder 39 reciprocate through fixed displacement distance D. Tappet holder 39 includes an inward shoulder 40 that moves in an annulus 35 defined in the side surface 33 of plunger 31. In this embodiment, the action of tappet 37 and tappet holder 39 can only cause plunger 31 to retract if the annulus height 36 is less than fixed displacement distance D plus the thickness of inward shoulder 40. Thus, annulus height 36 can be sufficiently large that plunger 31 can remain stationary despite the continued movement of tappet 37 and tappet holder 39. However, annulus height 36 is preferably chosen to be such that plunger 31 is retracted some minimum distance with each rotation of cam 28. Thus, when there is insufficient pressure acting on pressure face end 32 to cause plunger 31 to retract, such as during engine start-up periods, some minimal output from pump 16 can be maintained by choosing an annulus height 36 that causes some minimal amount of plunger retraction when tappet 37 and tappet holder 38 are reciprocating with the rotation of cam 28.

In order to control the output from pump 16, the present invention contemplates control of how far plunger 31 retracts between pumping cycles. In order to accomplish this, the present invention primarily relies upon fluid pressure acting on pressure face end 32 of plunger 31 in order to retract plunger 31 to refill pumping chamber 42 between pumping cycles. Thus, when fluid supply pressure in inlet pressure 48 is relatively high, the fluid force acting on pressure face end 32 will cause plunger 31 to follow tappet 37 such that its reciprocation distance is about equal to the fixed displacement distance D of cam 28. However, when fluid supply pressure in inlet passage 48 is relatively low, plunger 31 will retract only a relatively short distance between pumping cycles. A minimum pressure necessary to retract plunger 31 is controlled via the positioning of a trim spring 44 between plunger 31 and tappet 37. The pressure necessary to retract plunger 31, and hence the output of pump 16, is controlled by flow restriction valve 20, which is capable of controlling the supply pressure in inlet passage 48. When flow restriction valve 20 is at least partially closed, the pressure in inlet passage 48 is only sufficiently high to retract plunger 31 a distance that is less than the fixed displacement distance D of cam 28. It is important to note, however, that the pressure necessary to fully retract the plunger at one engine speed will be significantly different than another engine speed because the amount of time available for the plunger to retract is a function of the rotating shaft speed, which is driven directly by the engine. Thus, there are several design parameters that must be sized properly in order to provide a maximum amount of output control for pump 16 across its expected operation range. Among these are the output supply pressure from the oil circulation pump 13, the range of pressure drops available through flow restriction valve 20, the area of pressure face end 32 and the strength of trim spring 44, if any.

INDUSTRIAL APPLICABILITY

Figure 4A:
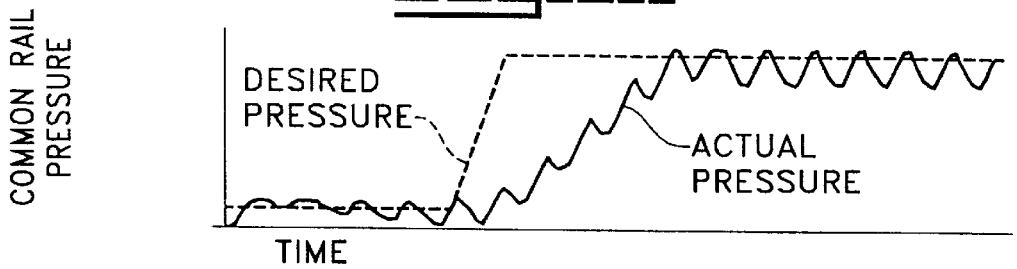
FIGS. 4*a–e* are graphs of common rail pressure, flow restriction valve position, plunger/tappet 1, 2 and 3 positions versus time, respectively, for a hydraulic system according to one aspect of the present invention.
Figure 4B:
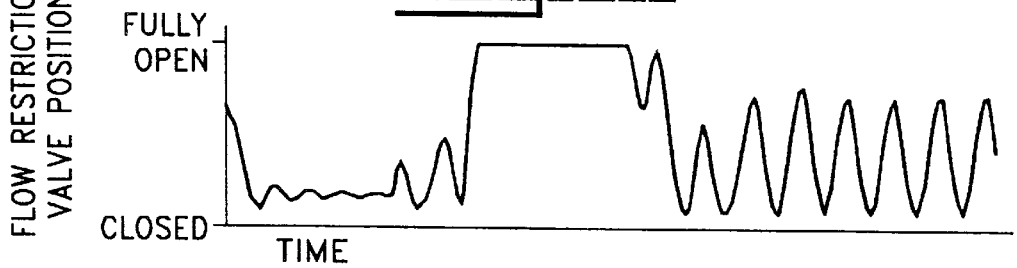
Figure 4C:
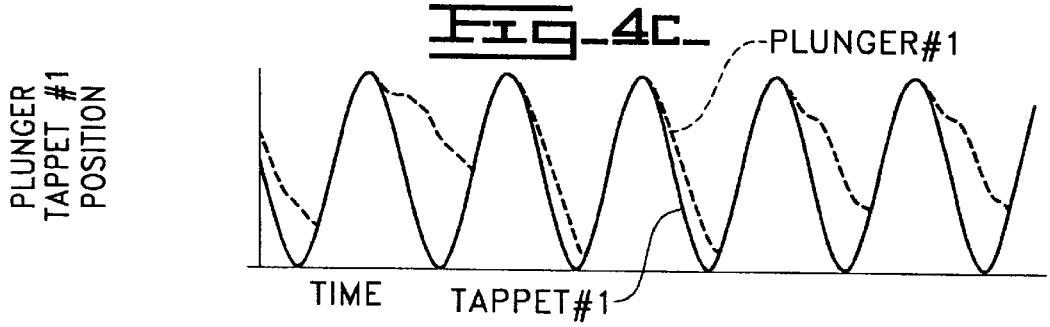
Figure 4D:
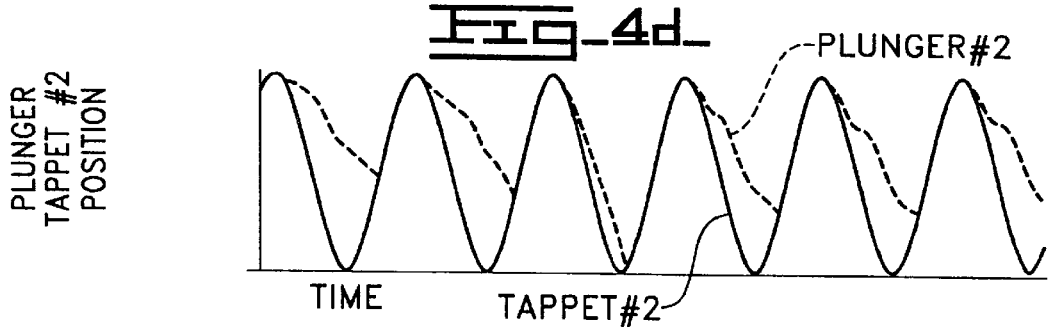
Figure 4E:
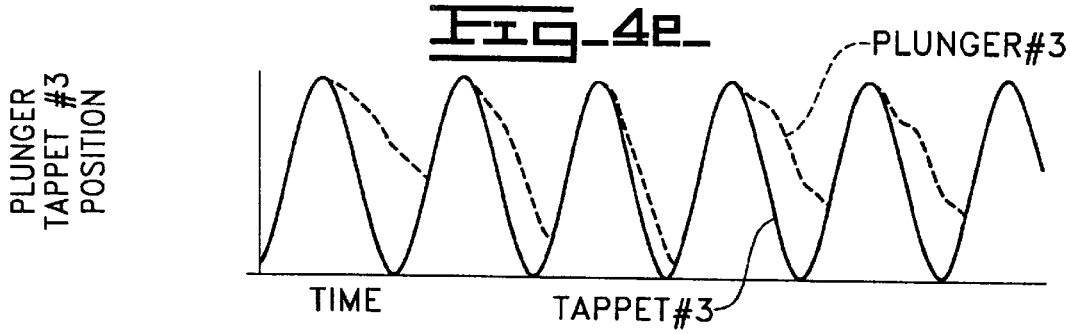

Referring now in addition to FIGS. 4*a–e*, several parameters are graphed over time for a sample operating period of the hydraulically-actuated system 11 of FIG. 1. These graphs show at their beginning that the common rail pressure can be maintained at a relatively low level by restricting flow through the flow restriction valve. FIGS. 4*c–e* show that this flow restriction causes the plungers to reciprocate each cycle through a distance that is substantially less than the fixed displacement distance moved by the tappet members. Thus, over a portion of each cycle, contact end 34 separates from contact surface 38 of tappet 37. Later in the cycle contact end 34 and contact surface 38 move together again, and the collision between these two pieces is damped through the presence of fluid and an appropriate sizing of damping orifice 29.

Toward the middle of the FIG. 4 graphs, the desired common rail pressure jumps to a relatively high level. In order to quickly raise the actual pressure in the common rail, the flow restriction valve 20 moves to a fully open position. This causes the plunger reciprocation distance to increase significantly almost matching the fixed reciprocation distance D moved by the tappets. After the actual rail pressure is raised up to the desired pressure, the flow restriction valve oscillates between various partially closed positions in order to maintain the actual pressure as close as possible to the desired common rail pressure. During this time period, the plungers move with the tappets over about a two-thirds portion of their effective stroke.

Figure 5A:
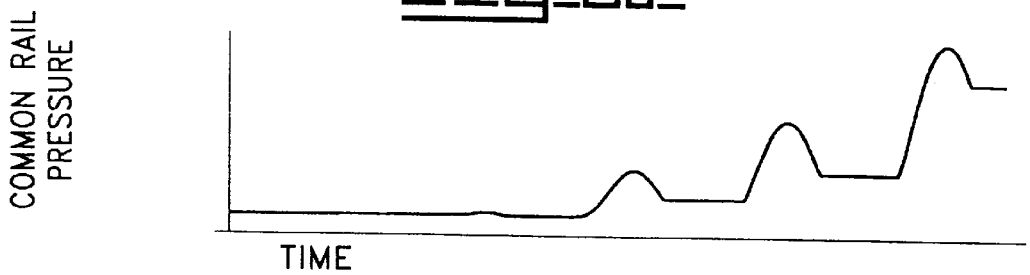
FIGS. 5*a–e* are graphs of common rail pressure, flow restriction valve position, plunger/tappet 1, 2 and 3 positions versus time, respectively, for a hydraulic system according to another aspect of the present invention.
Figure 5B:
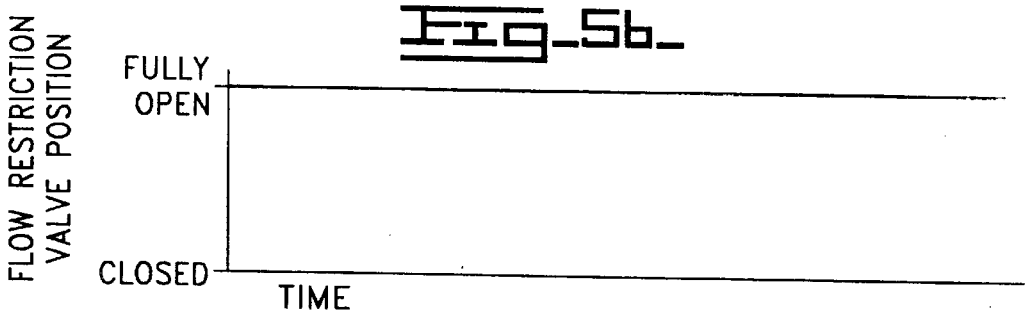
Figure 5C:
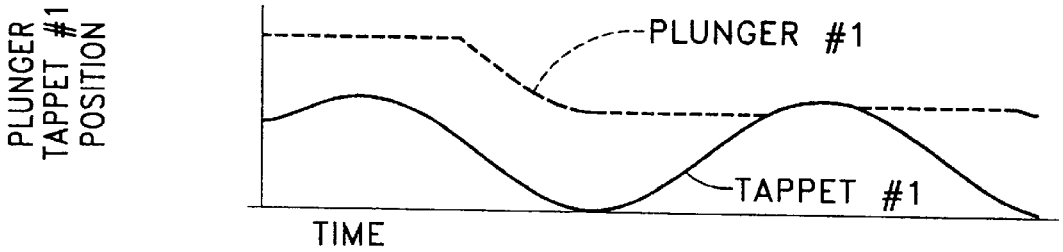
Figure 5D:
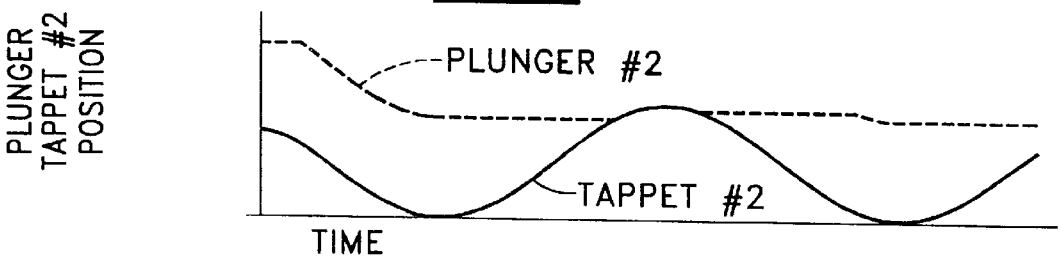
Figure 5E:
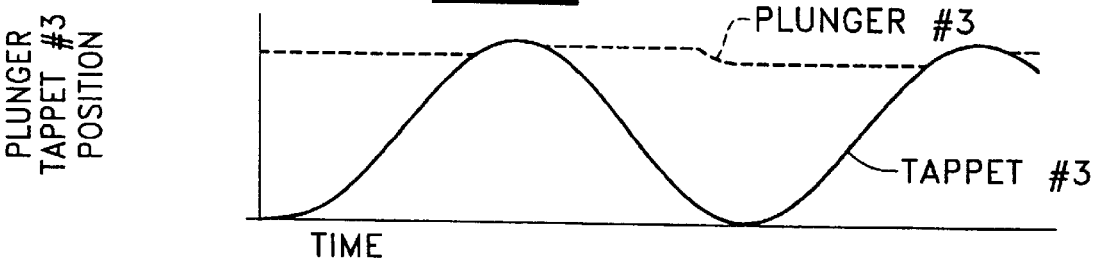

Referring now to FIGS. 5*a–c*, a sample start-up period for the hydraulic system of FIG. 1 is illustrated. In this example, it is assumed that due to cold starting viscosity conditions, etc., there is insufficient supply pressure to retract the plungers even though the flow restriction valve is fully open. During this start-up period, the fuel injectors 14 are not operated because there is not yet sufficient hydraulic pressure in the common rail in order to inject fuel at a desired pressure. These graphs illustrate the desirability of having some minimum retraction of the plungers built into the system in order to have some pump output from pump 16 during start-up low pressure high viscosity conditions. In this case, the annulus height 36 shown in FIG. 2 is small enough that the inward shoulder 40 of tappet holder 39 contacts an annular shoulder portion of annulus 35 to retract plunger 31 a minimum distance over each rotation of shaft 27. In this example, this minimum distance is about 10% to 15% of the total fixed reciprocation distance D of cam 28. Thus, these graphs show that with each successive small pumping stroke of plungers #1–3, the common rail pressure is raised incrementally. Eventually, pressure in the common rail would be sufficiently high that the fuel injectors would be able to operate sufficiently to start the engine. At that point, there should be sufficient supply pressure that the flow restriction valve can be used to control the retraction distances of the plungers, and hence the output from high pressure pump 16 and the magnitude of pressure in the common rail.

Unlike the prior art hydraulic systems, there is no need in the present invention to continuously dump high pressure oil back to the engine oil sump in order to maintain common rail pressure at the desired level. Thus, an engine utilizing a hydraulic system according to the present invention should experience an improved brake specific fuel consumption because the present invention is designed to make the pump output closely match the consumption level of the hydraulic fuel injectors. Thus, the pump of the present invention could find potential application in a variety of hydraulic systems, particularly those in which the pump output controls supply pressure to the hydraulic devices while substantially matching the consumption level of the devices.

Because the high pressure pump 16 of the present invention relies almost exclusively on fluid pressure to retract its plungers, rather than mechanical spring forces as in some prior art pumps, there is little chance that undesirable and potentially damaging cavitation bubbles will form within the pump. There is the possibility of cavitation development when the plunger is forced to retract a minimum distance due to a particular sizing of the annulus height 36, but the conditions for cavitation can be avoided by insuring that the flow restriction valve 20 is always at least partially open. Thus, by appropriately sizing various parameters and including a flow restriction valve in the pump inlet, the present invention can gain many of the advantages of a conventional fixed displacement pump, yet have the ability to vary delivery so that the pump can perform in a more efficient hydraulic system.

The above description is intended for illustrative purposes only, and is not intended to limit the scope of the present invention in any way. Various modifications can be made to the illustrated embodiment without departing from the intended spirit and scope of the invention, which is defined in terms of the claims set forth below.

What is claimed is:

1. A variable delivery liquid pump system including:

a housing defining an inlet, an outlet and a plunger bore;

a rotating shaft that includes a cam that defines a fixed displacement distance with each rotation of said shaft;

a plunger slidably positioned in said plunger bore;

a supply of liquid at a supply pressure attached to said inlet by a supply passage; and an output control mechanism that includes an electronically controlled flow restriction valve positioned in said supply passage, and said plunger retracting less than said fixed displacement distance during each rotation of said shaft when said flow restriction valve is at least partially closed.

2. The pump system of claim 1 wherein said supply pressure is sufficiently high to hydraulically retract said plunger said fixed displacement distance during each rotation of said shaft when said flow restriction valve is open; and said supply pressure being sufficiently low to hydraulically retract said plunger less than said fixed displacement distance during each rotation of said shaft when said flow restriction valve is at least partially closed.

3. The pump system of claim 1 further including a tappet positioned between said plunger and said cam; and a spring operably positioned to bias said tappet into contact with said cam.

4. The pump system of claim 1 further including an electronic control module in communication with and capable of controlling said flow restriction valve.

5. The pump system of claim 1 including a plurality of plungers distributed around said shaft and lying in a plane.

6. The pump system of claim 1 further comprising a minimum return mechanism operably positioned to retract said plunger a minimum displacement distance that is less than said fixed displacement distance during each rotation of said shaft.

7. The pump system of claim 1 including a plurality of plungers distributed around said shaft and lying in a plane, and further including:

a separate tappet positioned between each of said plungers and said cam; and a separate spring operably positioned to bias each said tappet into contact with said cam; and an electronic control module in communication with and capable of controlling said flow restriction valve.

8. The pump system of claim 6 further including a plurality of minimum return mechanisms operably positioned to retract each of said plungers a minimum displacement distance that is less than said fixed displacement distance during each rotation of said shaft.

9. A hydraulic system including:

a low pressure pump having an inlet connected to a source of liquid;

a high pressure pump with an outlet connected to a high pressure reservoir of said liquid, and having a rotating shaft with a cam that defines a fixed displacement distance with each rotation of said shaft, and further having at least one reciprocable plunger;

a supply passage extending between an outlet of said low pressure pump and an inlet of said high pressure pump;

at least one hydraulically actuated device with an inlet connected to said high pressure reservoir;

an output control mechanism capable of controlling a volume rate of said liquid delivered from said high pressure pump to said high pressure reservoir, and including an electronically controlled flow restriction valve positioned in said supply passage; and said at least one reciprocable plunger retracting less than said fixed displacement distance during each rotation of said shaft when said flow restriction valve is at least partially closed.

10. The hydraulic system of claim 9 further including:

a pressure sensor attached to said high pressure reservoir;

an electronic control module in communication with said pressure sensor, and further in communication with and capable of controlling said flow restriction valve.

11. The hydraulic system of claim 10 further including a pressure relief passage connected to said high pressure reservoir;

an electronically controlled pressure relief valve positioned in said pressure relief passage; and said electronic control module being in communication with and capable of controlling said pressure relief valve.

12. The hydraulic system of claim 10 wherein said liquid in said supply passage between said low pressure pump and said flow restriction valve is at a supply pressure;

said supply pressure being sufficiently high to hydraulically retract said plunger said fixed displacement distance during each rotation of said shaft when said flow restriction valve is open; and said supply pressure being sufficiently low to hydraulically retract said plunger less than said fixed displacement distance during each rotation of said shaft when said flow restriction valve is at least partially closed.

13. The hydraulic system of claim 10 wherein said high pressure pump includes a plurality of plungers distributed around said shaft and lying in a plane;

a separate tappet positioned between each of said plurality plungers and said cam; and a spring operably positioned to bias each said separate tappet into contact with said cam.

14. The hydraulic system of claim 10 further including a minimum return mechanism operably positioned to retract said reciprocable plunger a minimum displacement distance that is less than said fixed displacement distance during each rotation of said shaft.

15. A hydraulic subsystem including:

an engine including a lubricating oil sump;

a low pressure pump attached to said engine and having an inlet connected to said lubricating oil sump;

a high pressure pump attached to said engine with an outlet connected to a high pressure common rail, and having a rotating shaft with a cam that defines a fixed displacement distance with each rotation of said shaft, and further having a plurality of reciprocable plungers distributed around said shaft and lying in a plane;

an oil supply passage extending between an outlet of said low pressure pump and an inlet of said high pressure pump;

a plurality of hydraulically actuated devices with inlets connected to said high pressure common rail and outlets connected to said lubricating oil sump;

an output control mechanism capable of controlling a volume rate of said oil delivered from said high pressure pump to said high pressure common rail, and including an electronically controlled flow restriction valve positioned in said oil supply passage; and said plurality of reciprocable plungers retracting less than said fixed displacement distance during each rotation of said shaft when said flow restriction valve is at least partially closed.

16. The hydraulic subsystem of claim 15 further including:

a pressure sensor attached to said high pressure common rail;

an electronic control module in communication with said pressure sensor, and further in communication with an capable of controlling said flow restriction valve, and further in communication with an capable of controlling said plurality of hydraulically actuated devices.

17. The hydraulic subsystem of claim 16 further including a pressure relief passage extending between said high pressure common rail and said oil lubricating sump;

an electronically controlled pressure relief valve positioned in said pressure relief passage; and said electronic control module being in communication with and capable of controlling said pressure relief valve.

18. The hydraulic subsystem of claim 17 wherein said oil in said supply passage between said low pressure pump and said flow restriction valve is at a supply pressure;

said supply pressure being sufficiently high to hydraulically retract said plurality of reciprocable plungers said fixed displacement distance during each rotation of said shaft when said flow restriction valve is open; and said supply pressure being sufficiently low to hydraulically retract said plunger less than said fixed displacement distance during each rotation of said shaft when said flow restriction valve is at least partially closed.

19. The hydraulic subsystem of claim 18 further including a separate tappet positioned between each of said plurality plungers and said cam;

a spring operably positioned to bias each said separate tappet into contact with said cam;

an amount of damping oil positioned between said tappets and said plungers.

20. The hydraulic subsystem of claim 19 further including a minimum return mechanism operably positioned to retract said plurality of reciprocable plungers a minimum displacement distance that is less than said fixed displacement distance during each rotation of said shaft.

21. A variable delivery liquid pump system including:

a housing defining an inlet, an outlet and a plunger bore;

a rotating shaft;

a plunger slidably positioned in said plunger bore and being capable of sliding a fixed displacement distance with each rotation of said shaft;

a supply of liquid at a supply pressure attached to said inlet by a supply passage; and an output control mechanism that includes an electronically controlled flow restriction valve positioned in said supply passage, and said plunger retracting less than said fixed displacement distance during each rotation of said shaft when said flow restriction valve is at least partially closed.

* * * * *